US007583916B2

(12) United States Patent
Ogata et al.

(10) Patent No.: US 7,583,916 B2
(45) Date of Patent: Sep. 1, 2009

(54) IMAGE FORMING APPARATUS

(75) Inventors: Hiroaki Ogata, Mishima (JP); Syuhei Kawasaki, Susono (JP); Seiji Yamaguchi, Mishima (JP); Shinji Uehara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/988,703

(22) Filed: Nov. 16, 2004

(65) Prior Publication Data

US 2005/0117920 A1 Jun. 2, 2005

(30) Foreign Application Priority Data

Nov. 17, 2003 (JP) ..... 2003-386311

(51) Int. Cl.
*G03G 15/08* (2006.01)

(52) U.S. Cl. ..... 399/254; 399/255; 399/258

(58) Field of Classification Search ..... 399/254, 399/255, 258
See application file for complete search history.

(56) References Cited

U.S. PATENT DOCUMENTS 5,862,442 A * 1/1999 Ahn ..... 399/254 X
6,324,369 B1 11/2001 Yamaguchi et al. ..... 399/254

(Continued)

FOREIGN PATENT DOCUMENTS

EP 1 096 330 A2 5/2001
JP 60028675 A * 2/1985
JP 4-125670 4/1992
JP 07219348 A * 8/1995

(Continued)

OTHER PUBLICATIONS

Patent Abstracts of Japan, Publication No. 08006396, Jan. 12, 1996.

(Continued)

*Primary Examiner*—David M Gray
*Assistant Examiner*—Erika Villaluna
(74) *Attorney, Agent, or Firm*—Fitzpatrick, Cella, Harper & Scinto

(57) ABSTRACT

An image forming apparatus includes an image bearing member; a developing device including a carrying member for carrying a one component developer and for developing an electrostatic image formed on the image bearing member with the developer; a rotatable developer supplying device, contacted to the carrying member, for supplying the developer to the carrying member; a developer regulating device for regulating an amount of the developer carried on the carrying member; a developer stirring device for stirring the developer a developer supply device for supplying the developer to the developing device; and a controller for controlling supply of the developer to the developing device from the developer supply device. A lower end of the developer stirring device is disposed at a position which is vertically above an upper end of the developer supplying device and which is vertically above a contact portion between the carrying member and the developer regulating device. A direction of rotation of the developer supplying device is such that the developer supplying device is contacted to the carrying member during a downward part of the rotation of the developer supplying device. The controller controls the developer supply device such that a lower limit of a height of a surface of the developer is vertically above a lower end of the developer stirring device and an upper limit of the height of the surface of the developer is vertically below a wall of an upper surface of the developing device.

20 Claims, 9 Drawing Sheets

U.S. PATENT DOCUMENTS

| | | | | |
|---|---|---|---|---|
| 6,381,431 | B1 | 4/2002 | Kinoshita et al. | 399/175 |
| 6,415,125 | B1 | 7/2002 | Yamamoto et al. | 399/254 |
| 6,421,516 | B1 | 7/2002 | Kinoshita et al. | 399/254 |
| 6,560,430 | B2 * | 5/2003 | Muto et al. | 399/258 X |
| 2004/0265010 | A1 * | 12/2004 | Otani | 399/258 |

FOREIGN PATENT DOCUMENTS

| | | | | |
|---|---|---|---|---|
| JP | 8-6396 | | | 1/1996 |
| JP | 08286515 | A | * | 11/1996 |
| JP | 9-80894 | | | 3/1997 |
| JP | 9-236978 | | | 9/1997 |
| JP | 10-20640 | | | 1/1998 |
| JP | 10-198173 | | | 7/1998 |
| JP | 11-160988 | | | 6/1999 |
| JP | 11184147 | A | * | 7/1999 |
| JP | 11311899 | A | * | 11/1999 |
| JP | 2000-29290 | | | 1/2000 |
| JP | 2000-155468 | | | 6/2000 |
| JP | 2000-242080 | | | 9/2000 |
| JP | 2002-40776 | | | 2/2002 |
| JP | 2002-82520 | | | 3/2002 |
| JP | 2002-229313 | | | 8/2002 |
| KR | 1991-14759 | | | 8/1991 |
| KR | 1998-3923 | | | 3/1998 |

OTHER PUBLICATIONS

Patent Abstracts of Japan, Publication No. 10198173, Jul. 31, 1998.
Patent Abstracts of Japan, Publication No. 2000242080, Sep. 8, 2000.
Patent Abstracts of Japan, Publication No. 2002293313, Aug. 14, 2002.
Office Action dated Dec. 14, 2007, issued in European Patent Application No. 04 027 218.9-2209.

* cited by examiner

IMAGE FORMING APPARATUS

FIELD OF THE INVENTION AND RELATED ART

The present invention relates to an image forming apparatus which forms a visual image by developing an electrostatic image formed on an image bearing member with the use of an electrophotographic or electrostatic recording method, or the like, into a visible image with the use of a developing apparatus.

Here, an image forming apparatus includes, for example, a copying machine, a printer (LED printer for example, laser beam printer, etc.), facsimleing machine, wordprocessor, etc.

In the field of an electrophotographic image forming apparatus, there have been known such image forming apparatuses that as the toner as developer therein is consumed, the toner supply container, as a developer supply container, which is in the main assembly of the apparatus, and is removable from the main assembly of the apparatus, is replaced with a new toner supply container to supply the main assembly with toner.

FIG. 9 is a vertical sectional view of an example of an image forming apparatus, showing the general structure thereof. As shown in FIG. 9, the image forming apparatus is provided with an electrophotographic photosensitive member, as an image bearing member, that is, a photosensitive drum 100, in the form of a drum, which is located roughly in the center of the image forming apparatus, being rotatably supported so that it can be rotated in the direction indicated by an arrow mark.

As an image forming operation begins, a charging means 200 uniformly charges the peripheral surface of the photosensitive drum 100. Then, a laser beam projecting means 300 exposes the charged peripheral surface of the photosensitive drum 100; it scans the peripheral surface of the photosensitive drum 100 with a beam of laser light modulated with image formation data. As a result, an electrostatic latent image is formed on the peripheral surface of the photosensitive drum 100. A developing apparatus 400 develops the formed electrostatic latent image into a visual image, with the use of developer; it forms a so-called toner image.

This toner image is electrostatically transferred onto a recording medium P by the transfer electric field formed between the photosensitive drum 100 and a transfer roller 600, for example, as a transferring means, by the transfer roller 600. Then, the toner image on the recording medium P is fixed to the recording medium P by heat and pressure in a fixing apparatus 800 (heat roller 800*a* and pressure roller 800*b*).

The transfer residual toner, or the toner remaining on the peripheral surface of the photosensitive drum 100 after the transfer of the toner image, is removed by a cleaning apparatus 700 comprising a cleaning member in the form of a blade, for example. Therefore, the photosensitive drum 100 can be continuously used for image formation.

Next, the developing apparatus 400 employed by the above described image forming apparatus will be described in more detail.

The developing apparatus 400 is provided with a developer bearing member 401 which is for delivering developer to the photosensitive drum 100, and is formed of elastic substance. The developer bearing member 401 is positioned so that the peripheral surface of the developer bearing member 401 is placed in contact with the peripheral surface of the photosensitive drum 100 to develop the electrostatic latent image. This method of placing the developer bearing member 401 in contact with the photosensitive drum 100 in order to developer the electrostatic latent image on the peripheral surface of the photosensitive drum 100 has been known as the contact type developing method.

There have also been known such methods that the developing apparatus is supplied with toner, gradually or all at once, as the amount of the toner in the development chamber decreases. The developing apparatus 400 is designed to use single-component developer, in particular, nonmagnetic single-component developer. Hereinafter, single-component developer will be referred to simply as "toner", unless specifically noted.

There is stored toner in the developing apparatus 400, more specifically, in the developer container 406 of the developing apparatus 400. The developer container 406 is open on the side facing the photosensitive drum 100. A development roller 401 as a developer bearing member is supported so that it is partially exposed through this opening, and also, so that it can be rotated in the direction indicated by an arrow mark R5.

The developing apparatus 400 is also provided with a stirring paddle 404 as a means for conveying developer while stirring it, which is located on the inward side, that is, the opposite side of the developer container from the opening. The stirring paddle 404 is rotatable in the direction indicated by an arrow mark R6. It conveys toner, while stirring it, to an area D, which is in the adjacencies of the contact area between the development roller 401 and a toner supply roller 403, which will be described later.

The toner supply roller 403 as a developer supplying means is formed of an elastic substance, and is positioned so that it is rotated in contact with the development roller 401. The toner is conveyed by the stirring paddle 404 to the area D. Then, as the toner supply roller 403 is rotated in the direction indicated by an arrow mark R7, the toner is slightly increased in density, being thereby rendered uniform in density. Then, as the development roller 401 and toner supply roller 403 are rotated in such directions that their peripheral surfaces move in the opposite directions relative to each other, in the contact area, the toner is frictionally charged.

As the toner is charged in the contact area between the development roller 401 and supply roller 403, the toner is moved onto the peripheral surface of the development roller 401 by the mirror force resulting from the electric charge it acquired. Further, the developing apparatus 400 is provided with a blade 402 as a member for regulating the thickness of the developer layer on the peripheral surface of the development roller 401. The blade 402 is attached to the developer container 406 so that the free edge portion of the blade 402 is kept pressured against the peripheral surface of the development roller 401. Thus, as the development roller 401 is rotated, the toner on the peripheral surface of the development roller 401 is moved through the contact area between the development roller 401 and blade 402, and as it is moved through the contact area, it is regulated by the blade 402 so that it is formed into a thin layer of toner with a predetermined thickness. While the toner is moved through the contact area, it is further charged by being rubbed against the development roller 401 and blade 402. As a result, the toner is sufficiently charged for development.

Thereafter, as the development roller 401 is further rotated, the toner is conveyed to the development area (development nip) in which the peripheral surface of the photosensitive drum 100 is in contact with the peripheral surface of the development roller 401. To the development roller 401, voltage is applied from a power source (unshown). Therefore, a developmental electric field is formed between the photosensitive drum 100 and development roller 401. Thus, the toner on the development roller 401 is caused by this developmental electric field to transfer onto the photosensitive drum 100 in the pattern of the electrostatic latent image on the photosensitive drum 100. As a result, a visible image is formed of the toner on the peripheral surface of the photosensitive drum 100. This visible image, hereafter, will be referred to as the toner image. Referring to FIG. 9, in the case of a developing apparatus in which the development roller 401 is rotated so that its peripheral surface remains in contact with the peripheral surface of the photosensitive drum 100, not only the toner particles which form a toner image by selectively adhering to the numerous points of latent image, that is, the toner particles which contribute to development, but also, the toner particles remaining borne on the peripheral surface of the development roller 401, are rubbed against the peripheral surface of the photosensitive drum 100. This state of the toner (developer) on the peripheral surface of the photosensitive drum 100 is referred to as the "state in which the toner is in contact with the peripheral surface of the photosensitive drum 100", in this specification.

Among the toner particles coated on the peripheral surface of the development roller 401 and conveyed to the development nip N, those which remained on the peripheral surface of the development roller 401, that is, those which did not contribute to the development, are stripped away from the peripheral surface of the development roller 401 as they are rubbed by the supply roller 403 (means for supplying development roller with toner and stripping toner from development roller). Some of the toner particles stripped away from the development roller 401 are supplied to the supply roller 402 to the peripheral surface of the development roller 401, along with some of the toner particles supplied freshly to the supply roller, and the rest are returned to the developer container 406.

The above described image forming apparatus in accordance with the prior art, shown in FIG. 9, is provided with a toner hopper 500, which is located above the developer container 406. Next, this toner hopper 500 will be described.

The toner hopper 500 located above the developer container 406 is removably mountable in the main assembly of the image forming apparatus. As the toner in the developer container 406 reduces due to consumption, the image forming apparatus issues a request for toner supply container replacement. In response to this request, a user is to replace the toner supply container with a fresh toner container, and to remove the sealing member present at the opening located at the bottom of the hopper 500. As the toner sealing member is removed, the toner within the fresh toner container pours all at once into the developer container 406.

There have been proposed toner supplying methods different from the above described one, in which the toner in a toner container is poured all at once into the developer container 406. According to these methods, the amount of the developer remaining in the development chamber, in which a development bearing member such as a development roller or the like is located, is detected or estimated, and the development chamber is gradually supplied, as necessary, with the toner from a toner container, in response to the detected or estimated amount of the toner in the development chamber (Japanese Laid-open Patent Applications 9-80894, 10-20640, 2000-29290, 2000-155468, 2002-40776, etc.). Shown in FIG. 10 is an image forming apparatus employing one of such methods, in which the amount of the toner in the development chamber is detected or estimated, and the development chamber is gradually supplied as necessary with toner.

However, the image forming apparatuses shown in FIGS. 9 and 10 suffer from the following problems:

That is, in terms of the locations at which the toner particles are subjected to friction, first, the toner particles are subjected to friction between the supply roller 406 and development roller 401 when they are borne on the peripheral surface of the development roller 401, and secondly, they are subjected to friction between the developer roller 401 and blade 402 when they are regulated in the thickness of the layer in which they are allowed to remain on the peripheral surface of the development roller 401. Then, the toner particles are supplied for the development. Further, the toner particles which did not contribute to the development are stripped from the development roller 401 and are recovered into the developer container 406. In other words, the toner particles are also subjected to friction by the supply roller 403 while they are stripped from the development roller 401 by the supply roller 403. Moreover, in the case of an image forming apparatus employing the contact type developing method, the toner particles are subjected to friction between the photosensitive drum 100 and development roller 401 while a latent image is developed.

As described above, the above-mentioned sequential steps in the image forming process all involve the contact between the toner particles and the components pertinent to image formation. In other words, during image formation, the toner particles are subjected to load each time they come into contact with the components involved with image formation. Thus, there is the problem that some, or all, of the toner particles in the developer container 406 are damaged by the load; for example, the external additives coated on each toner particle are buried into the toner particle, and/or separate therefrom. As a result, the toner particles gradually deteriorate in fluidity, chargeability, and the like properties, of which the toner particles as developer are required.

According to the studies made by the inventors of the present invention, as normal toner particles, that is, toner particles which have not deteriorated in chargeability, fluidity, and the like properties, are added to the toner particles having deteriorated in chargeability, fluidity, and the like properties, the normal toner particles and deteriorated toner particles are attracted to each other, and therefore, agglomerate. As a result, the image forming apparatus sometimes outputted images which are nonuniform in density, images which are foggy, and images blotched by the larger toner particles resulting from the agglomeration.

Recently, this problematic phenomenon has is become more serious because of the following technical trends. That is, image forming apparatuses have been increased in printing speed. Further, the melting point of toner has been lowered because of the demand for energy conservation, more specifically, from the standpoint of fixation characteristic. Further, this problematic phenomenon has become even more serious because toner has been increased in fluidity, chargeability, etc., by the external additives such as silica.

Moreover, this problematic phenomenon sometime occurred whether the toner supplying method in which the toner in a toner supply container is released all at once into the developing apparatus as it was detected that the amount of the toner in a developing apparatus had been reduced to a critical level, or the toner supplying method in which a developing apparatus was divided into the development chamber containing the development roller, and the toner hopper, and in which the amount of the toner in the development chamber is detected, and the development chamber is gradually supplied with toner by the minimum amount necessary for satisfactory image formation, was used. This occurred because the fresh supply of toner, that is, the toner which had not deteriorated, was supplied to the development roller 401 as a developer bearing member, before it was sufficiently mixed with the is deteriorated toner in the development chamber.

Japanese Laid-open Patent Application 11-160988 proposes an image forming apparatus is structured so that its developer container is provided with three chambers, each of which contains a stirring member (FIG. 11). In the case of this image forming apparatus, while the image forming apparatus is supplied with toner, the stirring member in the central chamber is not rotated, and the deteriorated toner and freshly supplied toner are sufficiently stirred and mixed together in the chamber next to the opening of the developer container, through which toner is supplied. Then, after the apparatus is supplied with toner, the stirring member in the central chamber is rotated so that the mixture of the toners is moved into the chamber on the development roller side. However, providing each of the three chambers with its own stirring member makes the image forming apparatus rather complicated in structure, being therefore disadvantageous from the standpoint of reducing an image forming apparatus in size and cost.

SUMMARY OF THE INVENTION

The primary object of the present invention is to provide an image forming apparatus in which as the developing apparatus thereof is supplied with a freshly supply of developer, the freshly supplied developer is properly mixed with the developer which has been in the developing apparatus.

Another object of the present invention is to provide an image forming apparatus which is far less likely to output inferior images attributable to developer deterioration than an image forming apparatus in accordance with the prior art.

Another object of the present invention is to provide an image forming apparatus in which a fresh supply of developer is reliably stirred after it is supplied to the developing apparatus thereof.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be described in detail with reference to the most preferable embodiments of the present invention, and the appended drawings. It should be noted here that the dimensions, materials, and shapes of the structural components, and the positional relationship among them, in the following embodiments of the present intention are not intended to limit the scope of the present invention, unless specifically noted. Further, once a given component is described in terms of material, shape, etc., in the following description of the preferred embodiments of the present invention, it will remain the same in material, shape, etc., unless specifically noted.

Embodiment 1

Figure 1:
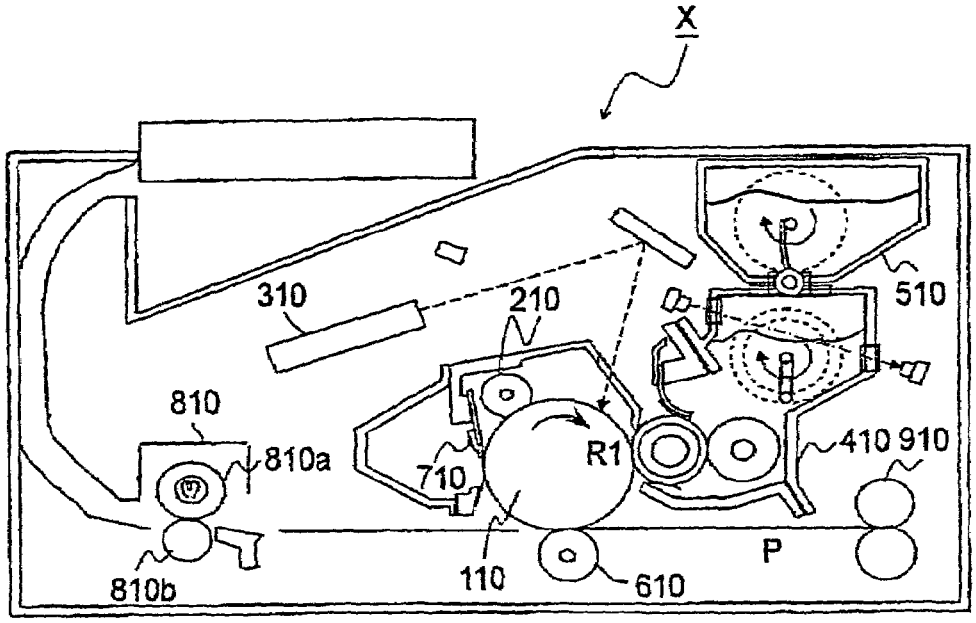
FIG. 1 is a schematic sectional view of the image forming apparatus in the first embodiment of the present invention.

FIG. 1 is a sectional view of the image forming apparatus in the first embodiment of the present invention, showing the general structure thereof. The image forming apparatus in this embodiment is an image forming apparatus for forming monochromatic images. However, this embodiment is not intended to limit the scope of the present invention; the present invention is also applicable to color image forming apparatuses capable of forming multicolor images.

The image forming apparatus X in this embodiment comprises an image bearing member (which hereinafter will be referred to as "photosensitive drum"), a developing apparatus for developing electrostatic latent images, a developer supplying means (which hereinafter will be referred to as "toner hopper") for supplying the developing apparatus with developer, and a controlling means for controlling the developer delivery from the developer supplying means to the developing apparatus.

The electrophotographic photosensitive member in the form of a drum, that is, photosensitive drum 110, is supported in the center portion of the image forming apparatus X so that it can be rotated in the direction indicated by an arrow mark R1. As an image forming operation is started, the charging means 210 uniformly charges the peripheral surface of the photosensitive drum 110. Then, a laser beam projecting means 310 as an exposing means exposes the peripheral surface of the photosensitive drum 110 to a beam of laser light which the exposing means projects while modulating it with image formation data. As a result, an electrostatic latent image is formed on the peripheral surface of the photosensitive drum 110.

In this embodiment, the polarity to which the photosensitive drum 110 is charged is negative. The electrostatic latent image which reflects the image formation data is a combination of the numerous points of the peripheral surface of the photosensitive drum 110, which were not exposed to the beam of laser light projected from the laser beam projecting means 310, and the numerous points of the peripheral surface of the photosensitive drum 110, which were reduced in negative charge due to their exposure to the beam of laser light.

Then, as the photosensitive drum 110 is further rotated, the electrostatic latent image is developed by the toner, that is, a type of developer, supplied by the developing apparatus, into a visual image; a visual image is formed of the toner on the peripheral surface of the photosensitive drum 110.

The image forming apparatus in this embodiment employs a reversal developing method. Therefore, the toner which adheres to the numerous points of the peripheral surface of the photosensitive drum 110, which have been reduced in negative charge is the same in polarity as the polarity to which the peripheral surface of the photosensitive drum 110 has been charged. The developer is stored in the toner hopper 510 as the developer supplying means, and is supplied to the developing apparatus 410 from the hopper 510.

Meanwhile, in synchronism with the arrival of the toner image on the peripheral surface of the photosensitive drum 110 at the transfer area, in which the peripheral surface of the photosensitive drum 110 is in contact with the peripheral surface of the transfer roller 610 as a transferring means, the recording mediums P are delivered to the transfer area, one by one, from an unshown cassette in which the recording mediums P are stored.

As the toner image on the photosensitive drum 110 and the recording medium P arrive at the transferring area, the toner image is transferred onto the recording medium P by the transfer electric field induced by the transfer roller 610. Then, the toner image (unfixed) on the recording medium P is subjected to the heat applied to the recording medium P and toner image by the fixing means (heat roller) 810*a* of the fixing apparatus, and the pressure applied by the pressing means 810*b* of the fixing apparatus. As a result, the toner image is permanently fixed to the surface of the fixing apparatus.

After the transfer of the toner image from the photosensitive drum 110, the photosensitive drum 110 is cleared of the residual toner (transfer residual toner) remaining on the peripheral surface of the photosensitive drum 110, by a cleaning apparatus 710, being thereby prepared for being continuously used for image formation.

Figure 2:
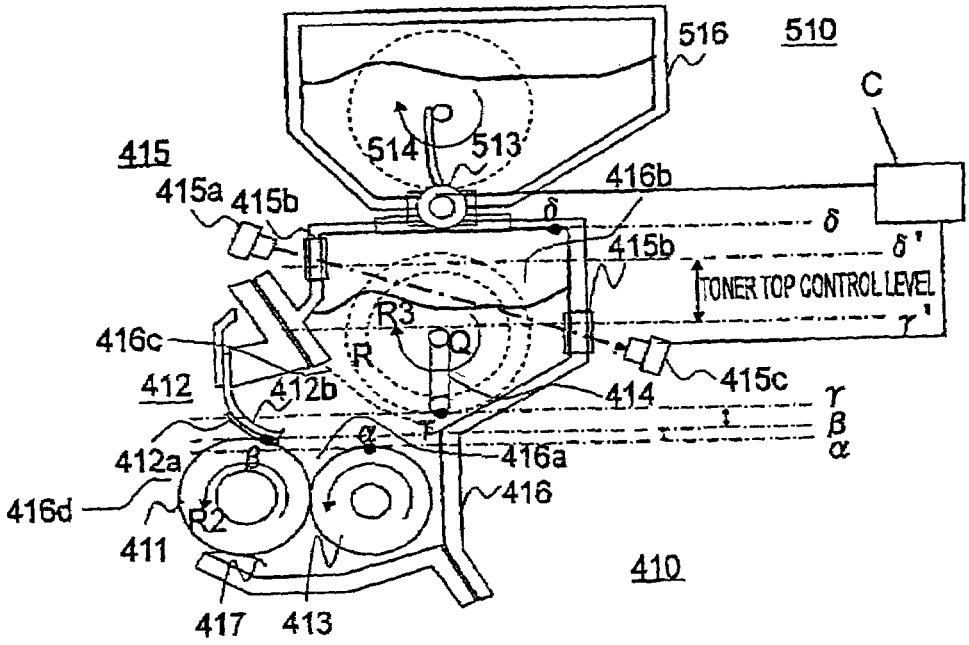
FIG. 2 is a sectional view of the essential portions of the developing apparatus and its toner hopper, in the first embodiment of the present invention.

Next, the developing apparatus 410 and the toner hopper 510 thereof will be described further. FIG. 2 is a sectional view of the essential portions of the developing apparatus 410 and toner hopper 510 thereof in this embodiment, showing the general structures thereof.

In this embodiment, the developing apparatus 410 is provided with: a developer bearing member (which hereinafter will be referred to as "development roller") for placing the developer in contact with the image bearing member to develop the electrostatic latent image; a developer supplying means (which hereinafter will be referred to as "supply roller") for supplying the developer bearing member with developer; a developer regulating member (which hereinafter will be referred to simply as "blade") for forming a thin layer of developer on the peripheral surface of the developer bearing member, from the body of developer supplied to the peripheral surface of the developer bearing member by the developer supplying means; a developer stirring member (which hereinafter will be referred to as "stirring member") which is movable to mix the developer having just been supplied from the developer supplying means, with the developer which was in the developing apparatus, a developer level detecting means (which hereinafter will be referred to as "toner level detecting means") for detecting the level of the surface of the body of developer in the adjacencies of the developer stirring means.

The developing apparatus 410 employs the contact development method in which the development roller 411 is placed in contact with the photosensitive drum 110, and the development process is carried out, with the layer of developer on the development roller 411 kept in contact with the peripheral surface of the photosensitive drum 110.

Further, the developer used in this embodiment is nonmagnetic single-component developer (toner), the inherent electrical polarity of which is negative. It is one of the toners which have been created to reduce the amount of energy consumed by the fixing apparatus, and the particles of which are structured to contain such a substance that softens at a relatively low temperature. As the method for manufacturing the toner, one of the developer manufacturing methods disclosed in Japanese Patent Application Publication 63-10231, Japanese Laid-open Patent Applications 59-53856 and 59-61842, etc., may be employed, which uses the suspension polymerization method.

The toner particles are spherical, and are 6 μm in volume average particle diameter. They have the so-called core/shell internal structure; they comprises a core formed of substance which softens at a relatively low temperature, and an external resin layer, or shell, which covers the core formed of substance which softens at a relatively low temperature. The shell portion is formed by polymerization.

By carrying out the suspension polymerization process at the normal temperature and under pressure, it is possible to obtain such toner, the particles of which are microscopic and spherical, and the distribution curve of the particle diameter of which is very sharp in curvature (majority of toner particles are in the range of 3-8 μm in diameter). The toner obtained with the use of such a manufacturing method is also sharp in the curvature of the weight average electric charge distribution curve, and therefore, is capable of uniformly developing a latent image in terms of development contrast.

It is possible to use toner different from the one produced with the use of suspension polymerization. For example, it is possible to use toner directly produced by dispersion polymerization from aqueous organic solvent capable of solving monomeric toner while incapable of dissolving polymeric toner, toner produced by direct polymerization with the presence of water-soluble polar polymerization initiator, toner produced by emulsion polymerization, for example, soap-free polymerization, or the like.

The shape factors SF-1 and SF-2 of the toner used as developer in this embodiment are in the ranges of 100-140, and 100-120, respectively. In other words, the particles of the toner used in this embodiment are spherical in practical terms. The definitions of the shape factors SF-1 and SF-2 are the values obtained using the following method: 100 toner images are randomly sampled with the use of FE-SEM (S-800) (product of Hitachi, Ltd.), and the obtained image data are analyzed by inputting them into Image Analyzing Apparatus (Luzex3) (Nikore Co., Ltd.) through an interface. Then, SF-1 and SF-2 are calculated from the following equations (1) and (2):

$$SF\text{-}1=(MXLNG)^2/\text{AREA}\times(p/4)\times 100 \quad (1)$$

$$SF\text{-}2=(PERI)^2/\text{AREA}\times(1/4p)\times 100 \quad (2)$$

AREA: projected area

MXLNG: maximum cord length

PERI: circumference of projection.

The shape factor SF-1 indicates degree of sphericity. For example, if the SF-1 of a given toner is no less than 140, the toner is noncircular, and the greater it is, the less spherical. As for the shape factor SF-2, it indicates degree of surface irregularity; the greater the SF-2 of a given toner, the rougher the surfaces of the toner particles. For example, if the surface factor SP-2 of a given toner is no less than 120, the surfaces of the particles of the toner are rather rough.

The toner in this embodiment contains additives such as silica added to improve the toner in terms of such properties as chargeability, fluidity, etc. The additive may be different from silica, as long as it has the same functions as silica. For example, the additive may be selected from among metallic oxides such as aluminum oxide, tin oxide, strontium titanate, zinc oxide, and magnesium oxide, nitride such as silicon nitride, carbide such as silicon carbide, allotropy of carbon such as carbon black and graphite, metallic salt such as calcium sulphate, barium sulphate, and calcium carbonate, and metallic salt of fatty acid, etc.

As described above, the particle of the toner, the internal structure of which includes the core/shell structure, is sometimes destroyed by the load to which the particle is subjected during image formation. If a toner particle is destroyed in internal structure, it loses its rigidity, and once it loses its rigidity, it is likely to weld itself to the development roller 411 and blade 412.

Next, the various components of the developing apparatus 410 will be described.

Referring to FIG. 2, the developing apparatus 410 has the developer container 416, in which toner is stored. The developer container 416 has: a development chamber 416*a*, in which the development roller 411, supply roller 413, and blade 412 are disposed; a stirring chamber 416*b* in which the stirring member 414 is disposed; and an opening 416*c* through which toner is moved from the stirring chamber 416*b* to the development chamber 416*a*. The stirring chamber 416*b* is above the development chamber 416*a*, with the opening 416*c* present between the stirring chamber 416*b* and development chamber 416*a*. The opening 416*c* is positioned so that the plane of the opening intersects with the plane perpendicular to the vertical direction. By structuring the developer container 416 so that the plane of the opening 416*c* is tilted relative to the plane perpendicular to the vertical direction, it is possible to reduce the size (height) of the developer container 416, and therefore, it is possible to reduce the vertical dimension of the developing apparatus.

The developer container 416 has another opening 416*d*, which faces the photosensitive drum 110. The development roller 411 is supported by the developer container 416 so that it is partially exposed through the opening 416*d*, and can be rotated in the direction indicated by an arrow mark R2. The development roller 411 is formed of an elastic substance, and is kept pressed upon the photosensitive drum 110 so that a predetermined amount of contact pressure is maintained between the peripheral surfaces of the development roller 411 and photosensitive drum 110. The developer container 416 is also provided with a blow-out prevention sheet 417, which is attached to the bottom edge of the opening 416*d*, being placed in contact with the peripheral surface of the development roller to prevent toner from scattering outward of the developer container 416 from below the development roller 411.

The development roller 411 is an semiconductive elastic roller formed of rubber (silicone rubber, urethane rubber, etc.) or foamed version thereof, which is relatively low in hardness, and in which electrically conductive substance (carbon, or the like) has been dispersed, or the combination thereof.

The stirring member 414 is located above the opposite side of the opening 416*d* from the development roller 411. It is rotatable in the direction indicated by an arrow mark R3. There is a stirring area R in the developer container 416. The stirring area R is where a fresh supply of toner is mixed into the toner which has been in the developer container 416, as the fresh supply of toner is supplied to the developer container 416 from the toner hopper 510.

The developing apparatus 410 is provided with a toner level detecting means 415 for detecting the position of the top surface of the body of toner in the stirring area R. The toner level detecting means employs an optical detecting means which comprises a light emitting portion 415*a*, a pair of light transmission windows 415*b*, and a light receiving portion 415*c*. The light emitting portion 415*a* and light receiving portion 415*c* are on the opposite sides of the stirring area R, one for one. The light transmission windows 415*b* are in the opposing walls of the developer container 416, one for one, to guide the light emitted from the light emitting portion 415*a* to the stirring area R, and then, to the light receiving portion 415*c*. Thus, the two light transmission windows 415*b* are positioned on the straight line connecting the light emitting portion 451*a* and light receiving portion 415*c*. The toner level detecting means 415 structured and positioned as described above detects the ratio of the length of time the beam of light is allowed to transmit through the developer container when the level of the top surface of the body of toner in the developer container is changed by the rotation of the stirring member 424, and estimates the level of the top surface of the body of toner in the stirring area R.

Located below the stirring area R is the supply roller 413 for supplying the development roller 411 with toner and recovering toner from the development roller 411. The supply roller 413 is placed in contact with the development roller 411. The supply roller 413 is an elastic roller formed of foamed elastic substance. It is rotated in such a direction that its peripheral surface moves in the opposite direction from the rotation direction of the development roller 411, in the contact area between the development roller 411 and supply roller 413.

The toner in the developer container 416 is thoroughly stirred by the stirring member 414, in the stirring area R, and then, is moved through the opening 416*c* primarily by gravity, reaching the supply roller 413, by which it is supplied to the development roller 411.

To the developer container 416, the blade 412 as the member for regulating the thickness of the layer in which the developer is formed, is attached so that it is kept pressed against the peripheral surface of the development roller 411. The blade 412 is an elastic regulating member made up of a piece of thin springy metallic plate 412*b*, and a dielectric layer 412*a* formed on the surface of the metallic plate 412*b* on the development roller side. The body of toner borne on the peripheral surface of the development roller 411 is regulated by the blade 412, in the thickness of the thin layer into which it is formed. As a result, a thin layer of toner uniform in thickness is formed on the peripheral surface of the development roller 411. Further, as the body of toner on the peripheral surface of the development roller 411 is regulated by the blade 412, the toner is sufficiently charged for development, by the friction between the toner and the surfaces of the development roller 411 and blade 412.

Then, the thin layer of toner on the development roller 411 is conveyed by the rotation of the development roller 411, to the development area (development nip) in which the peripheral surfaces of the photosensitive drum 110 and development roller 411 are in contact with each other. In the development area, the toner is supplied to the photosensitive drum 110, with the thin layer of toner on the development roller 411 remaining in contact with the peripheral surface of the photosensitive drum 110. More specifically, the development roller 411 is connected to an electric power source (unshown) on the main assembly side of the image forming apparatus, in order to form a developmental electric field between the photosensitive drum 110 and development roller 411. As a result, the toner on the development roller 411 is transferred by the developmental electric field onto the peripheral surface of the photosensitive drum 110, in the pattern reflecting the electrostatic latent image on the peripheral surface of the photosensitive drum 110. As a result, a visible image is formed of toner on the peripheral surface of the photosensitive drum 110.

The portion of the toner, which was coated on the peripheral surface of the development roller 411 and conveyed to the development nip, but did not contribute to the development of the latent image, is moved past the development nip, remaining borne on the peripheral surface of the development roller 411, and is conveyed to the contact area between the development roller 411 and supply roller 412. Then, it is frictionally stripped away by the supply roller 412 from the development roller 411. A part of the toner stripped away from the development roller 411 is supplied, along with the fresh supply of toner on the supply roller, by the supply roller 412 onto the development roller 411, and the rest is returned to the developer container 416.

In this embodiment, the supply roller 413 performs two functions: not only does it function as the means for supplying the development roller 411 with toner, but also, as the means for recovering toner from the development roller 411. This embodiment, however, is not intended to limit the scope of the present invention. In other words, the developer supplying means and developer recovering means may be independently provided.

The process speed (photosensitive drum speed) of the image forming apparatus X in this embodiment is 150 mm/sec, whereas the peripheral velocity of the development roller 411 in this embodiment is 225 mm/sec.

The developing apparatus 410 is structured so that it can be removably mounted. It is to be replaced with a new one as it reaches the end of its expected service life (30,000 copies calculated in A4 size).

In terms of positional relationship among the abovementioned components of the developing apparatus 410, the stirring member 414 is positioned so that the level of the lowest point γ of the sweeping range of the stirring member 414 will be above the higher of the level of the highest point a of the supply roller 413 and the contact point β between the blade 412 and development roller 411 (which in this embodiment is point β between blade 412 and development roller 411). In other words, the point γ is at a higher level than the points α and β.

The controlling means C (FIG. 2) of the main assembly of the image forming apparatus X receives from the toner level detecting means 415 the information regarding the level of the top surface of the body of toner in the stirring area R, and controls the amount by which toner is to be supplied to the developer container 416 from the toner hopper 510 so that the level of the top surface of the body of toner in the stirring area R will remain within a predetermined range, more specifically, above the level of the lowest point γ of the sweeping range of the stirring member 414, and below the level of the point d of the top wall of the developer container 416 of the developing apparatus 410. More precisely, the controlling means C controls the amount by which toner is to be supplied to the developer container 416 so that the level of the top surface of the body of toner in the stirring range R will remains between the level of the point γ' which is at the higher level than the level of the lowest point γ of the sweeping range of the stirring member 414, and the level of the point d' which is lower than the level of the point d of the top wall of the developer container 416 of the developing apparatus 410. Incidentally, the controlling means C is not shown in FIGS. 3, 4, and 8.

As the controlling means, it is possible to employ a CPU, or a dedicated electrical circuit. Further, the point d of the top wall of the developer container 416 of the developing apparatus 410 means the highest point of the internal surface of the top wall of the developer container 416.

Within the toner hopper 510, a stirring member 514 for loosening the toner in the toner hopper 510, and a supply roller 513 for supplying toner from the toner hopper 510 to the developing apparatus 410, are disposed. The supply roller 513 supplies toner to the developing apparatus 410 by a predetermined rate per unit length of time it is driven, in response to a supply command issued based on the data regarding the developing apparatus 410, that is, the information from the toner level detecting means 415.

Next, it will be described how the amount of the toner is detected, and how the toner is supplied.

In this embodiment, the toner level detecting means 415 is capable of detecting at least two different toner levels (which in this embodiment are levels of points γ' and d' in FIG. 2).

As the toner level detecting means 415 detects that the toner level in the developer container 416 has fallen, due to an image forming operation, to the level of the point γ', that is, the lower of the abovementioned two toner levels detectable by the toner level detecting means 415, the controlling means C with which the main assembly of the image forming apparatus X is provided issues a toner supply command to begin to release toner from the toner hopper 510 at a predetermined rate per unit length of time. Then, as the toner level detecting means 415 detects that the toner level in the developer container has risen to the level of the point d', that is, the higher of the levels of the abovementioned two points γ' and d', due to the continuous supply of toner from the toner hopper 510, the controlling means C stops the toner supply command to stop the driving of the supply roller 513, in order to stop the toner delivery from the toner hopper 510.

As a result, the level of the body of toner in the developer container 416 is controlled so that it will remain within a predetermined range, that is, between the level γ' which is higher than the level of the lowest point γ of the sweeping range of the stirring member 414, and the level d' which is lower than the level of the highest point d of the top wall of the developer container 416 of the developing apparatus 410.

In this embodiment, the level γ' is set to be higher than the level of the center Q (rotational center) of the sweeping range of the stirring member 414, whereas the level d' is set to be lower than the level of the highest point of the sweeping range of the stirring member 414.

The supply roller 513 is disposed straight above the stirring area R, ensuring that the toner supplied to the developing apparatus 410 moves through the stirring area R.

With the provision of the above described structural arrangement, the amount of the toner in the developer container 416 is controlled so that the top surface of the body of toner in the stirring area R in the developing apparatus 410 remains at the proper level for the toner which has been in the developing apparatus 410, and a fresh supply of toner, are thoroughly stirred and mixed by the starring member 414.

After being supplied to the developing apparatus 410, the fresh supply of toner is thoroughly mixed and stirred with the toner which has been in the developing apparatus 410. Then, as the toner in the developing apparatus 410 is consumed, the mixture is gradually moved to the adjacencies of the supply roller 413 primarily by gravity. Therefore, it does not occur that the freshly supplied toner in the developing apparatus 410 is supplied to the development roller 411 without being thoroughly mixed with the toner which has been in the developing apparatus 410. Therefore, the images irregular in density, foggy images, and blotchy images resulting from the generation of abnormally large toner particles, are not produced.

The toner level is controlled in a manner to prevent the top surface of the body of toner in the developer container 416 from reaching the top wall of the developer container 416. Therefore, it does not occur that because the developer container 416 is filled up with an oversupply of toner, the toner in the developer container 416 is increased in pressure. Therefore, the problems that toner deterioration is accelerated by the increase in toner pressure: toner leaks from the developing apparatus 410 (developer container 416) because of the increase in toner pressure; greater amount of torque is needed to drive the developing apparatus 410 because of the increase in toner pressure; images irregular in density are formed because toner is nonuniformly coated on the development roller 411 due to the increase in toner pressure, can be prevented.

In the endurance tests in which the image forming apparatus structured as described above was used to output three thousand copies, which is equivalent to the length of the service life of the developing apparatus, images irregular in density, foggy images, and/or blotchy images resulting from the generation of abnormally large toner particles, were not produced, proving that the image forming apparatus in this embodiment of the present invention can continuously output excellent images.

Regarding the positional relationship among the structural components of the developing apparatus 410 in accordance with the present invention, all that is necessary is for the following inequality (3) to be satisfied;

highest point a of supply roller 413<contact point β between blade 412 and development roller 411<lowest point γ of sweeping range of stirring member 414 (3)

Figure 3:
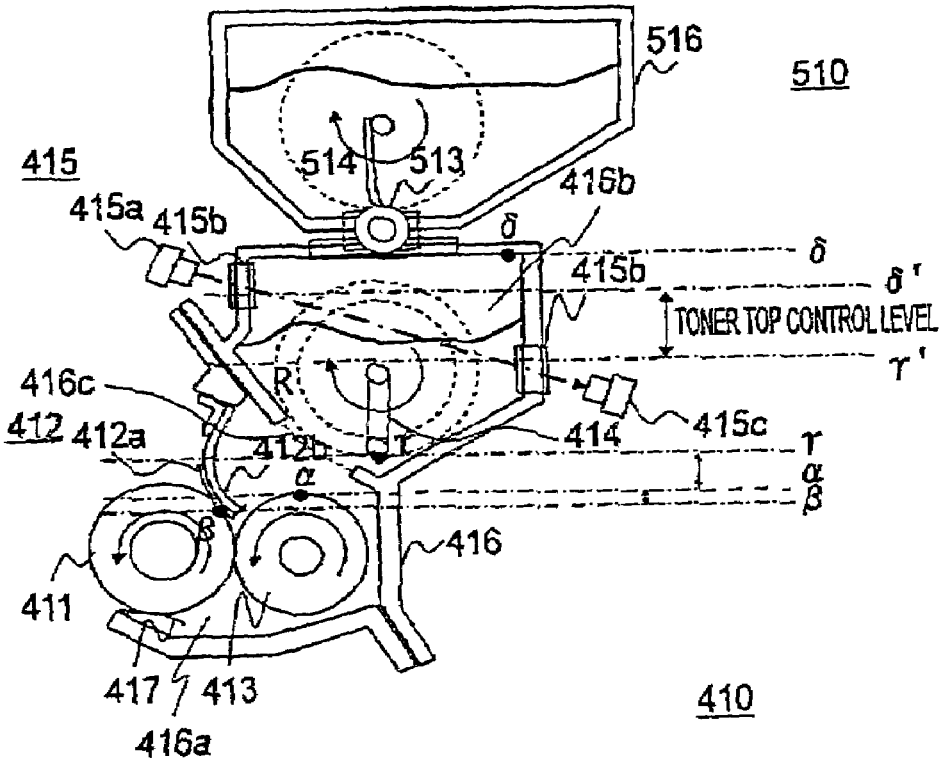
FIG. 3 is a sectional view of the essential is portions of a different version of the developing apparatus and its toner hopper in the first embodiment of the present invention.

Further, if the positional relationship, in vertical direction, between the highest point a of the supply roller 413 and contact point β between blade 412 and development roller 411 is reversed as shown in FIG. 3, the developing apparatus 410 has only to be structured so that the lowest point γ of sweeping range of stirring member 414 will be at a level higher than the level of the highest point a of the supply roller 413, that is, the higher of the points α and β.

In this case, the inequality to be satisfied by the positional relationship among the structural components is:

contact point β between blade 412 and development roller 411<highest point a of supply roller 413<lowest point γ of sweeping range of stirring member 414 (4)

Referring to FIG. 3, then designing the developing apparatus 410 so that the stirring chamber 416*b* having the stirring area R, and the development chamber 416*a* having the development roller 411 and supply roller 413, are separated by the partitioning wall having the opening 416*c* roughly in the center thereof in terms of the vertical direction, it is desired that not only are the above described requirements satisfied, but also, the stirring area R will be straight above the opening 416*c*.

Figure 4:
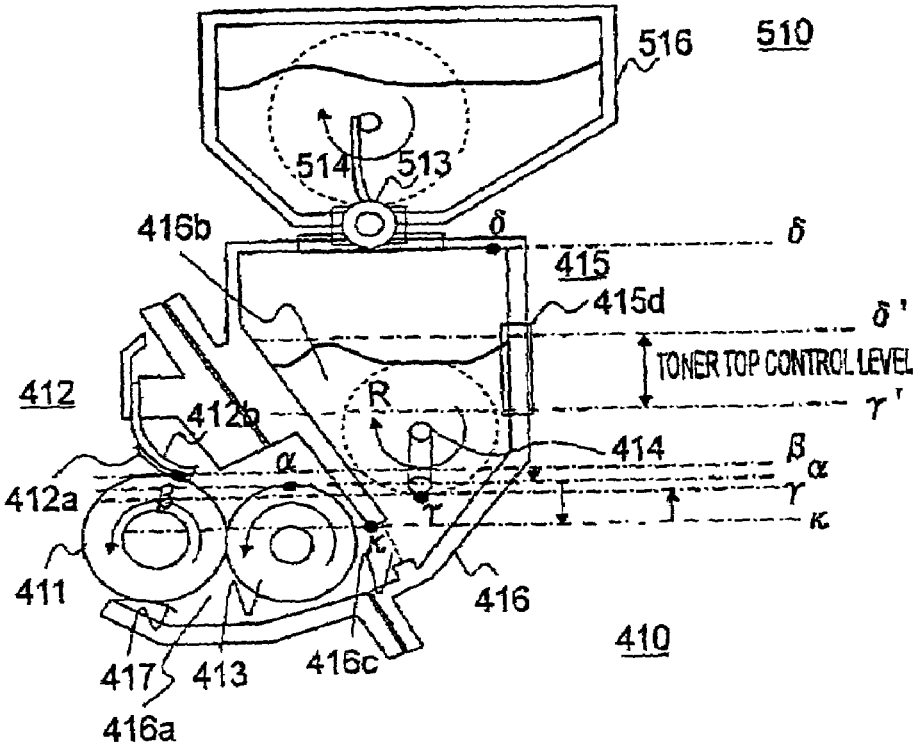
FIG. 4 is another sectional view of the essential portions of another version of the developing apparatus and its toner hopper.

Referring to FIG. 4, when designing the developing apparatus 410 so that the stirring chamber 416*b* having the stirring area R, and the development chamber 416*a* having the development roller 411 and supply roller 413, are separated by the partitioning wall having the opening 416*c* virtually at the bottom thereof in terms of the vertical direction, it is desired that the highest point κ of the opening 416*c* will be at a level lower than the lower of the highest point α of the supply roller 413 and the contact point β between the blade 412 and development roller 411, and also, that the lowest point γ of the sweeping range of the stirring member 414 will be at the level above the highest point κ of the opening 416*c*.

With the abovementioned structural components of the developing apparatus 410 disposed as described to above, as a fresh supply of toner is supplied to the developing apparatus 410, it is thoroughly mixed with the toner which has been in the developing apparatus 410, and is gradually supplied by gravity to the development chamber 416*a* to be used for development, as the toner in the development chamber 416*a* is consumed. Therefore, it does not occur that the freshly supplied toner is supplied to the development roller 411 without being thoroughly mixed with the toner which has been in the developing apparatus 410. Therefore, images irregular in density, images suffering from fogs, and images suffering from the blotches attributable to the agglomeration of toner, are not produced.

The inequalities which must be satisfied regarding the positional relationships among the abovementioned structural components, shown in FIGS. 3 and 4, in accordance with the present invention are:

highest point κ of the opening 416*c*<contact point β between blade 412 and development roller 411<highest point a of the supply roller 413, and highest point κ of the opening 416*c*<lowest point γ of sweeping range of stirring member 414 (5)

or highest point κ of the opening 416*c*<highest point a of the supply roller 413<contact point β between blade 412 and development roller 411, and highest point κ of the opening 416*c*<lowest point γ of sweeping range of stirring member 414 (6).

In this embodiment, the range γ'-d' in which the toner level is to be kept is preset to be higher than the center (rotational center) of the stirring member 414, and below the level of the highest point of the sweeping range of the stirring member 414. However, it has only to be optionally set in accordance with the shape, revolution, external diameter, etc., of the stirring member 414, in order to ensure that toner is always present within the sweeping range of the stirring member 414, and the body of toner in the developer container 416 does not come into contact with the top wall of the developer container 416, that is, the level of the top surface of the body of toner in the developer container 416 is higher than the level of the lowest point γ of the sweeping range of the stirring member 414 and below the level of the highest point d of the internal surface of the top wall of the developing apparatus 410 (developer container 416), in consideration of the degree of accuracy at which the toner level is detected by the toner level detecting means 415.

In the case of a developing apparatus which employs the rotational stirring means 414 or the like, the aforementioned predetermined range γ'-d' is desired to be higher than the level of the lowest point γ of the sweeping range of the stirring member 414, by ⅓ the diameter of the sweeping range of the stirring member 414, and lower than the level of the highest point of the sweeping range of the stirring member 414. It is preferred that the abovementioned predetermined range γ'-d' is higher than the level of the center Q (rotational center) of the stirring member 414, and lower than the level of the highest point of the sweeping range of the stirring member 414. With the provision of such arrangement, it is possible to enhance the stirring effect of the stirring means.

In this embodiment, an optical detecting means is employed as the toner level detecting means 415. However, a sensor 415*d* of the piezoelectric resonator type, such as the one shown in FIG. 4, may be employed as the toner level detecting means 415. Also, the toner level detecting means in this embodiment capable of detecting whether or not the toner level may be within the above described predetermined range in this embodiment, may be optionally replaced with a toner level detection element employing a distortion gauge, a piezoelectric sheet, or the like, a toner level detecting means of the electrostatic antenna type, or the like.

Further, regarding the position of the supply roller 513 relative to the stirring area R, it is not mandatory that the supply roller 513 is disposed straight above the stirring area R as it is in this embodiment. For example, the developing apparatus 410 may be structured so that the supply roller 513 is disposed diagonally above the stirring area R, or in the like direction, as long as it is assured that the is fresh supply of toner released from the toner hopper 510 is guided to the stirring area R by the wall of the developer container 416 or the like.

Embodiment 2

Next, the second embodiment of the present invention will be described.

The second embodiment is different from the first one in that: (1) the developing apparatus in the second embodiment is in the form of a process cartridge in which a photosensitive drum, a charge roller, and a cleaner unit are integrally disposed, and which is rendered removably mountable in the main assembly of an image forming apparatus so that as the process cartridge reaches the end of the estimate length of its service life, it can be replaced with a new one; (2) the image forming apparatus in the second embodiment is a full-color image forming apparatus of the in-line type, that is, a full-color image forming apparatus in which four process cartridges for developing yellow (Y), cyan (C), magenta (M), and black (K) colors, one for one, are aligned in the direction in which a recording medium is conveyed; (3) the supply roller of the toner hopper in the second embodiment is capable of adjusting the amount by which toner is delivered from the toner hopper per unit length of time the supply roller of the toner hopper is driven; (4) the process cartridge is provided with a memory as a storage means; etc.

The process cartridge is a cartridge in which a minimum of one processing means among the charging means, developing apparatus, and cleaning means, and an electrophotographic photosensitive member are integrally disposed, and which is removably mountable in the main assembly of an image forming apparatus.

Figure 5:
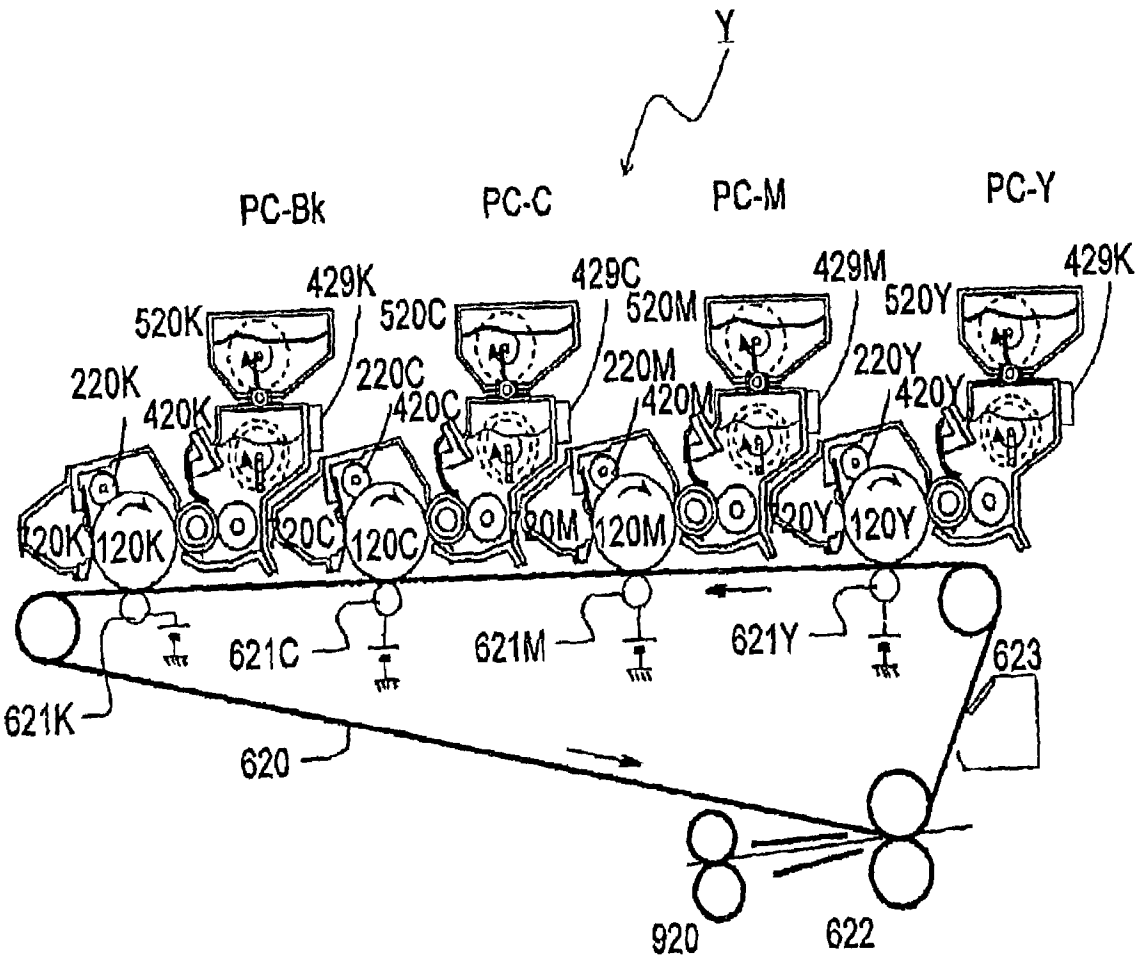
FIG. 5 is a sectional view of the essential portions of the developing apparatus and its toner hopper in the second embodiment of the present invention.

The image forming apparatus Y shown in FIG. 5 is a full-color laser beam printer, which comprises an intermediary transferring member 620 as a second image bearing member onto which the four color toner images formed on the four photosensitive drums, one for one, are transferred in layers to form a full-color image.

Figure 6:
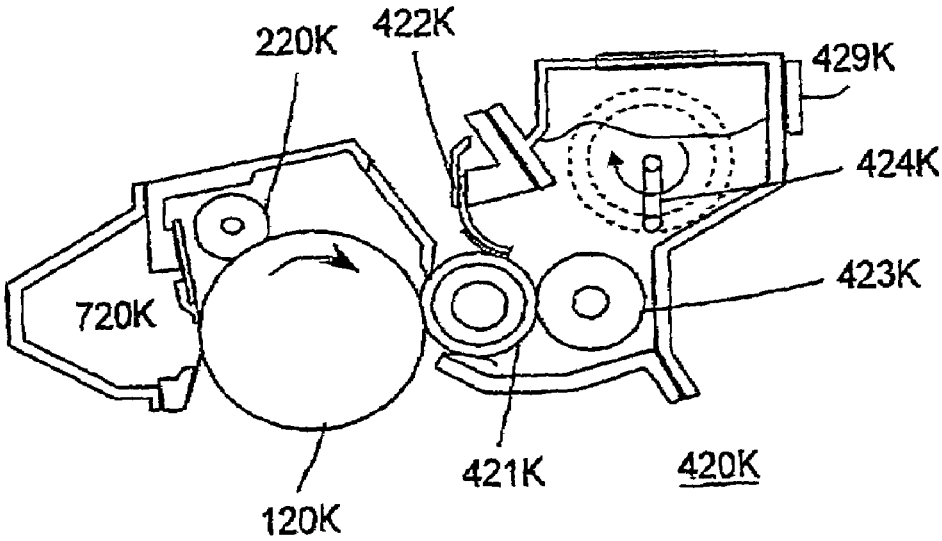
FIG. 6 is a schematic sectional view of the process cartridge in the second embodiment of the present invention.

Each of the developing apparatuses 420 (420Y, 420M, 420C, and 420K), which is similar to that in the first embodiment, is in the form of a process cartridge PC in which a photosensitive drum 210, a charge roller 220, and a cleaner unit 720 are integrally disposed. The process cartridge PC is rendered removably mountable in the image assembly of the image forming apparatus so that as it reaches the end of its service life, it can be replaced with a new one. The image forming apparatus Y employs four process cartridges PC (PC-Y, PC-M, PC-C, and PC-K) which are removably mountable in the main assembly of the image forming apparatus, and contain yellow, magenta, cyan, and black toners, respectively (FIG. 6 shows process cartridge for black color).

The structures, operations, etc., of the photosensitive drum, development roller, charge roller, etc., in each of the process cartridges PC (PC-Y. PC-M, PC-C, and PC-K) are identical to those in the first embodiment, and therefore, will not be described here. The process cartridges PC (PC-Y, PC-M, PC-C, and PC-K) are provided with nonvolatile memories 429 (429Y, 429M, 429C, and 429K) as storage means, respectively. In this embodiment, the memories 429 (429M, 429M, 429C, and 429K) are attached to the developing apparatuses 420 (420Y, 420M, 420C, and 420K), respectively.

If necessary because of spatial limitation, process cartridge structure, etc., the memory 429 may be attached to the developer supplying means. The memory 429 is capable of storing the value of the predetermined amount by which toner is supplied per unit length of time.

The four color toner images formed on the four photosensitive drums 120, one for one, by the yellow, magenta, cyan, and black color developing process cartridges PC (PC-Y, PC-M, PC-C, and PC-K), respectively, are transferred in layers onto the intermediary transferring member 620 in the order the process cartridges PC (PC-Y, PC-M, PC-C, and PC-K) are positioned in terms of the direction in which the intermediary transferring member is circularly moved. Then, the color toner images on the intermediary transferring member 620 are transferred onto the transfer medium while the transfer medium is conveyed by a pair of feed rollers 920. Then, the color toner images are fixed by the heat and pressure applied by an unshown fixing apparatus, being turned into a permanent full-color image. Lastly, the recording medium having the permanent full-color image is discharged from the image forming apparatus.

Figure 7:
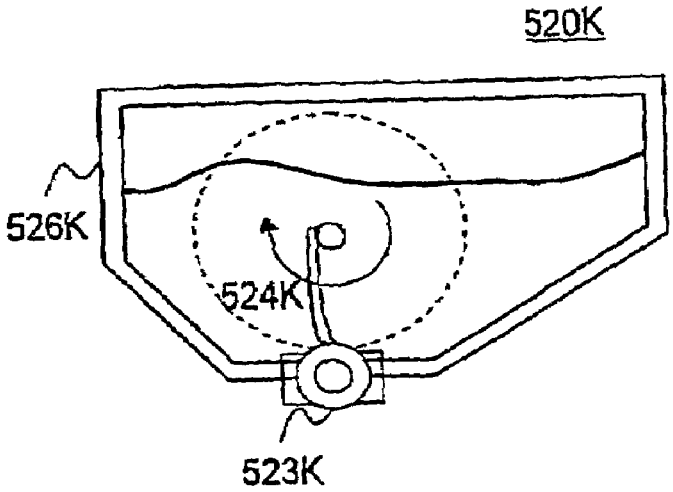
FIG. 7 is a schematic sectional view of the toner hopper in the second embodiment of the present invention.

Next, referring to FIG. 7, the toner hoppers 520 (520Y, 520M, 520C, and 520K) in this embodiment, which are similar to the toner hopper 510 in the first embodiment, are removably mountable in the main assembly of the image forming apparatus; the four toner hoppers 520 are individually and removably mountable in the main assembly of the image forming apparatus, independently from the developing apparatuses 420.

Within each toner hopper 520, a stirring member 524 for loosening the toner in the toner hopper 520, and a supply roller 523 for supplying toner from the toner hopper 520 to the developing apparatus 420, are disposed. The supply roller 523 supplies toner to the developing apparatus 410 by a predetermined rate per unit length of time it is driven, in response to a supply command issued by the controlling means.

Each of the hoppers 520 is provided with a means for varying the amount by which developer is supplied to the developing apparatus 420 per unit length of time. More specifically, the hopper 520 is provided with a mechanism for varying the rotational speed of the supply roller 523. Thus, it is possible to supply the developing apparatus 420 with toner by a predetermined amount per unit length of time. Further, the toner is supplied while varying the "amount by which toner is supplied per unit length of time" with the use of a controlling method which will be described later.

Initially, an "amount A by which toner is to be supplied per unit length of time" is stored in the memory 429. As a new process cartridge PC is mounted, the image forming apparatus Y reads this "amount A by which toner is supplied per unit length of time" from the memory 429, and then, sets the number of times the supply roller 523 is to be rotationally driven, based on the value read from the memory 429. As a result, the developing apparatus 420 is supplied little by little with toner by the amount proportional to the "amount A by which toner is to be supplied per unit length of time" during an image forming operation.

Figure 8:
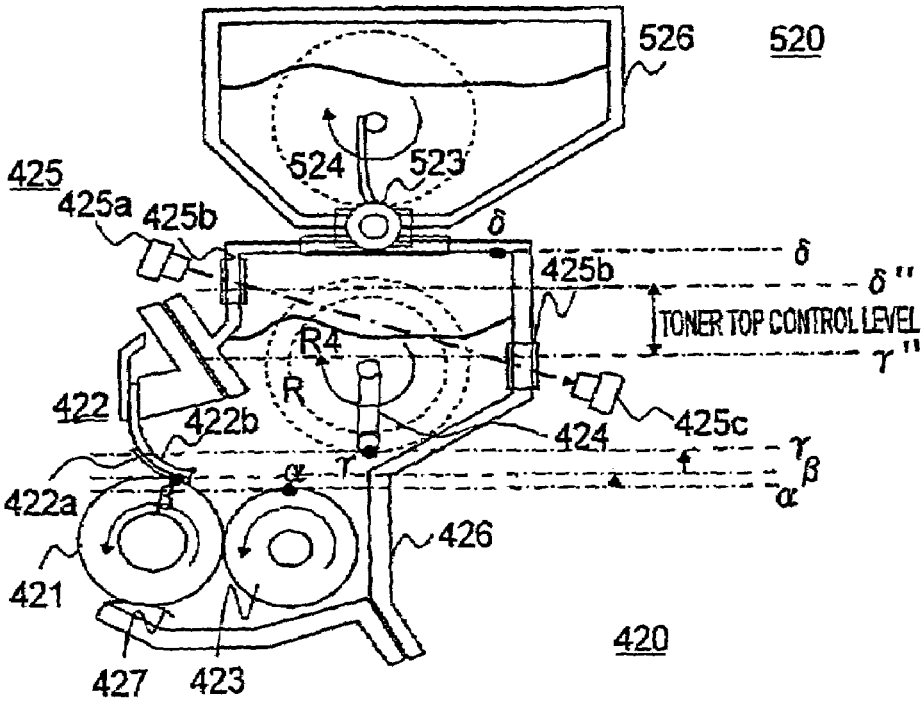
FIG. 8 is a sectional view of the essential portions of the developing apparatus and its toner hopper in the second embodiment of the present invention.
Figure 9:
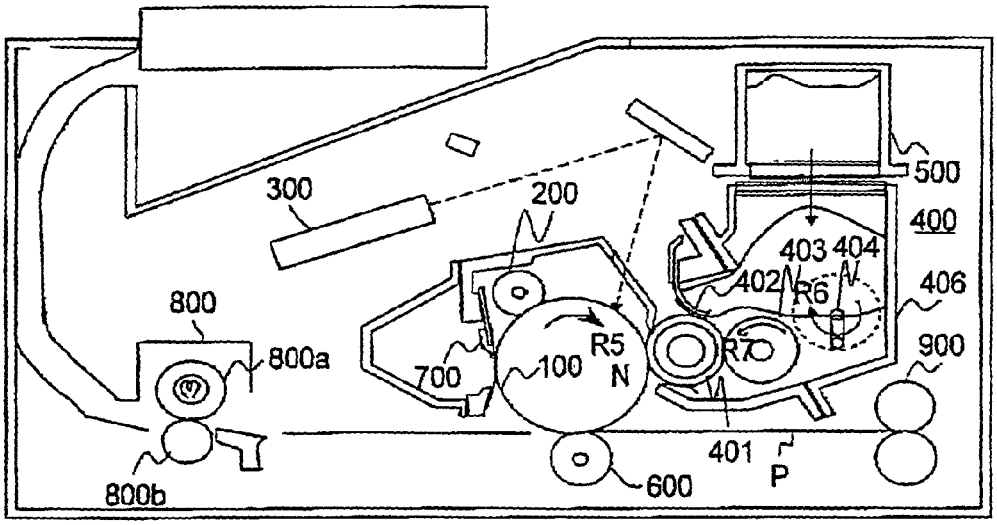
FIG. 9 is a schematic sectional view of an example of an image forming apparatus, showing the general structure thereof.
Figure 10:
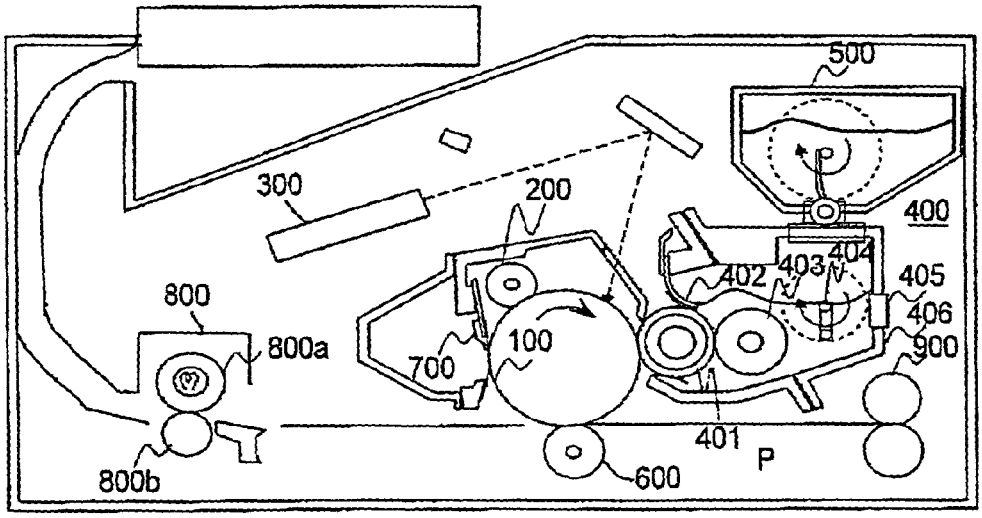
FIG. 10 is a schematic sectional view of another example of an image forming apparatus, showing the general structure thereof.
Figure 11:
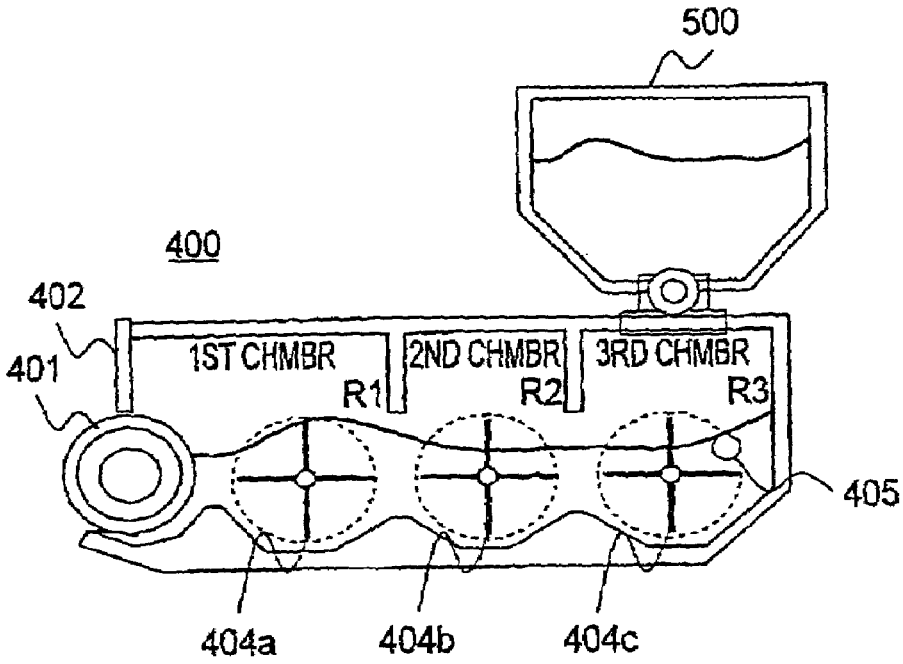
FIG. 11 is a sectional view of the developing apparatus, and the essential portion of the toner hopper of the developing apparatus.

Next, referring to FIG. 8, how the developing apparatus 420 is supplied with toner based on the detected amount of the toner in the stirring area R within the developing apparatus 420 will be described.

Within the developer container 426 of the developing apparatus 420, a stirring member 424 is disposed as is the stirring member 414 in the first embodiment, so that it can be rotated in the direction indicated by an arrow mark R4. Also within the developer container 426, the stirring area R is provided, in which the toner which has been in the developer container 426 is mixed with the fresh supply of toner from the toner hopper 520.

The developing apparatus 420 is provided with a toner level detecting optical means 425 for detecting the level of the top surface of the body of toner in the stirring area R. The toner level detecting means employs an optical detecting means which comprises a light emitting portion 425*a*, a pair of light transmission windows 425*b*, and a light receiving portion 425*c*. The toner level detecting means 425 detects the ratio of the length of time the beam of light is allowed to transmit through the developer container when the level of the top surface of the body of toner in the developer container is changed by the rotation of the stirring member 424, and estimates the level of the top surface of the body of toner in the stirring area R.

In this embodiment, the toner level detecting means 425 is capable of at least two levels (levels γ" and d" in FIG. 8) of the top surf ace of the body of toner in the developer container 426.

As the toner level detecting means 425 detects that the toner level in the developer container 426 has fallen, due to an image forming operation, to the level γ", that is, the lower of the above-mentioned two toner levels detectable by the toner level detecting means 425, the controlling means with which the main assembly of the image forming apparatus Y is provided increases the amount by which developer is delivered per unit length of time from the topper hopper 520, more specifically, switches the "amount A by which toner is to be delivered per unit length of time" to an "amount B by which toner is to be delivered per unit length of time" causing the image forming apparatus Y to increase the number of time the supply roller 523 is rotationally driven, based on this newly set value. During the rest of the image forming operation, the image forming apparatus Y supplies the developing apparatus 420 with toner, little by little, by the amount proportional to the "amount B by which toner is to be supplied per unit length of time". In this embodiment, "amount A by which toner is to be supplied per unit length of time"<"amount B by which toner is to be supplied per unit length of time": A<B, and $$B=A\times 5 \quad (7).$$

The image forming apparatus Y changes the contents of the memory 429 of the process cartridge PC to the "amount B by which toner is to be supplied per unit length of time" at the same time as it switches the "amount by which toner is to be supplied" from A to B.

Similarly, as the toner level detecting means 425 detects the level d", or the higher of the aforementioned two levels, the controlling means of the main assembly of the image forming apparatus Y reduces the amount by which developer is supplied from the toner hopper 520 per unit length of time. In other words, it changes the "amount A by which toner is to be supplied" to an "amount C by which toner is to be supplied". Then, based on this new "amount C by which toner is to be supplied", the image forming apparatus Y reduces the number of times the supply roller 523 is rotationally driven. Then, for the rest of the image forming operation, the image forming apparatus Y supplies the developing apparatus 420 little by little with toner by the amount proportional to the "amount C by which toner is to be supplied per unit length of time". In this case, "amount A by which toner is to be supplied">"amount C by which toner is to be supplied", and $$C=A\times 0.02 \quad (8).$$

The image forming apparatus Y replaces the contents of the memory 429 of the process cartridge PC with the "amount C by which toner is to be supplied", at the same time as it changes the "amount by which toner is to be supplied", from A to C.

Thereafter, as the toner level detecting means 425 detects the level γ", that is, the lower of the above described two levels, the controlling means of the image forming apparatus Y changes the "amount C by which toner is to be supplied" to the "amount B by which toner is to be supplied", whereas as the toner level detecting means 425 detects the level d", that is, the higher of the above described two levels, the controlling means of the image forming apparatus Y changes the "amount B by which toner is to be supplied" to the "amount A by which toner is to be supplied". Based on these values, the image forming apparatus Y resets the number of times the supply roller 523 is to be rotationally driven to supply the developing apparatus 420 with toner, little by little, by the amount proportional to the reset "amount by which by which toner is to be supplied per unit length of time".

As a result, the level of the top surface of the body of toner in the developing apparatus 410 remains in the predetermined range, that is, between the level γ" of the lowest point γ of the sweeping range of the stirring member 424 and the level d' of the highest point d of the internal surface of the top wall of the developer container 426.

With the provision of the above described structural arrangement, not only effects similar to those obtained by the structural arrangement in the first embodiment, but also, the following effects can also be obtained.

That is, whereas the developer supplying mechanism in the first embodiment is structured so that a small amount of toner is intermittently supplied, the developer supplying mechanism in the second embodiment is structured so that during an image forming operation, a small amount of toner is continuously supplied, and also, so that the amount by which toner is supplied per unit length of time is increased as necessary. Therefore. It is possible to reduce the average amount by which toner is supplied per unit length of time, making it thereby possible to increase the relative length of time the toner having been in the developing apparatus 410 is mixed, while being stirred, with the fresh supply of toner by the stirring member. Therefore, the toner having been in the developing apparatus 410 is more thoroughly mixed with the fresh supply of toner, improving the level of quality with which images are formed.

Further, the contents of the memory 429, as storage means, of the process cartridge PC are replaced with the new "amount by which toner is to be supplied per unit length of time" to which the "amount by which toner is to be supplied per unit length of time" has been changed according to the toner level in the adjacencies of the stirring member 24 in the developing apparatus 420. Therefore, even if a given process cartridge PC removed from one image forming apparatus is mounted into another image forming apparatus, the developing apparatus 420 in this process cartridge PC can be immediately supplied with toner by a proper amount; it is unnecessary to wait for the results of toner level detection.

In this embodiment, two referential toner levels are set, against which the toner level in the developer container 426 detected by the toner level detecting means is compared. However, three or more referential toner levels may be set according to such factors as the accuracy of the toner level detecting means, and the like, so that the higher the toner level, the smaller the amount by which toner is supplied, and also, so that the lower the toner level, the greater the amount by which toner is supplied. With the employment of such a multistage controlling method, the present invention is more effective; the level of the top surface of the body of toner in the developer container relative to the stirring member remains more stable.

Further, the image forming apparatus Y may be programmed so that when it is detected by the toner level detecting means that the developer level in the developer container 426, which is affected by an image forming operation, is at the highest of the multiple referential toner levels, the developer delivery from the developer supplying means is stopped, whereas when it is detected by the toner level detecting means that the toner level in the developer container 426 is at the level other than the highest of the multiple referential levels, the developer delivery from the developer supplying means is restarted.

Further, the image forming apparatus Y may be designed so that as the toner level detecting means detects that the developer level in the developer container 426, which is affected by the image forming operation, has fallen to the lowest of the multiple referential levels due to the image forming operation, the informing means of the main assembly of the image forming apparatus informs an operator that the toner hopper is in the abnormal condition, or that the toner hopper is out of toner, suggesting thereby the operator to replace the process cartridge PC or developing apparatus.

The controlling method in this embodiment varies the "amount by which toner is to be supplied per unit length of time" by changing the number of times the supply roller 523 is rotationally driven. However, this embodiment is not intended to limit the scope of the present invention. For example, a developing apparatus may be provided with multiple toner supplying member so that the amount by which toner is supplied can be varied by varying the number of the toner supplying members to be driven (sweeping area size control), or the supply roller may be frequently turned on and off with short intervals while varying the ratio between the length of time the supply roller is rotated, and the length of time the supply roller is not rotated (supply time control).

In this embodiment, the means for storing the information regarding the "amount by which developer is to be supplied per unit length of time" is attached to the process cartridge PC. However, in the case of a development unit structured so that the developing apparatus is removably mountable in the image forming apparatus independently from the photosensitive drum, the storage means may be attached to the development unit.

In the case of a setup such as the one in the first embodiment, in which the "amount by which developer is to be supplied per unit length of time" is not changed, the storage means may be attached to the toner hopper to store the "amount by which developer is to be supplied per unit length of time". With the employment of such an arrangement, even if the variation in the performance of a developer supplying means, which occurs during the manufacture of a developer supplying means, makes one developing apparatus different from the other in terms of the optimum "amount by which developer is to be supplied per unit length of time", compensation can be made by changing the contents of the storage means, and therefore, it is possible to supply the developing apparatus with toner by a proper amount in spite of the variation.

Further, the information to be stored in the storage means is optional as long as it is related to the "amount by which toner is to be supplied per unit length of time". For example, it may be the amount of toner itself, the number of the rotation of the toner supplying means, ratio between the length of time the toner supplying means is rotated, and the length of time the toner supplying means is not rotated, number of the stirring means to be rotated, size of the toner supplying opening, or the like.

With the employment of the above described structural arrangement, as a fresh supply of toner is supplied to the developing apparatus, the freshly supplied toner is thoroughly fixed with the toner having been in the developing apparatus, and the mixture is gradually moved by gravity into the adjacencies of the supply roller, development roller, and blade, to be used for development. Therefore, it does not occur that the freshly supplied toner is moved into the adjacencies of the development roller without being thoroughly mixed with the toner having been in the developing apparatus. Therefore, images irregular in density, images suffering from fogs, and/or images suffering from blotches attributable to the toner agglomeration, are not formed.

Further, the toner level is controlled so that the top surface of the body of toner in the developer container does not come into contact with the top wall of the developer container. Therefore, it does not occur that the developer container is overfilled with a fresh supply of toner. Therefore, it does not occur that the toner pressure in the developer container becomes excessive. Therefore, the problems attributable to the excessive toner pressure, more specifically, the problems that toner deterioration is accelerated; toner leaks from the developing apparatus; images irregular in density are outputted because toner is nonuniformly coated on the development roller toner; the torque necessary to drive the developing apparatus (image forming apparatus) is increased; etc., do not occur. Further, it possible to provide a small and inexpensive image forming apparatus capable of offering the above described effects.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 386311/2003 filed Nov. 17, 2003, which is hereby incorporated by reference.

What is claimed is:

1. An image forming apparatus comprising:

an image bearing member;

a developing device including a carrying member for carrying a one component developer and for developing an electrostatic image formed on said image bearing member with the developer;

rotatable developer supplying means, contacted to said carrying member, for supplying the developer to said carrying member;

developer regulating means for regulating an amount of the developer carried on said carrying member;

a developer supply device for supplying the developer to said developing device;

developer stirring means for stirring the developer supplied from said developer supply device and for supplying the developer to said developer supplying means; and control means for controlling a supply of the developer to said developing device from said developer supply device, wherein a lower end of a moveable range of said developer stirring means is disposed at a position which is vertically above an upper end of said developer supplying means and which is vertically above a contact portion between said carrying member and said developer regulating means, wherein said control means controls said developer supply device such that an upper limit of a height of a surface of the developer is vertically below a wall of an upper surface of said developing device, wherein a level of the surface of the developer maintained by said control means is higher than a level which is not lower, in a vertical direction, than a level of the lower end of the moveable range of said developer stirring means by ⅓ of a height between an upper end and the lower end of the moveable range of said developer stirring means, and wherein the level of the surface of the developer maintained by said control means is not higher than an upper end of the moveable range of said developer stirring means, and the level of the surface of the developer is higher than the upper end of said developer supplying means and is higher than the contact portion.

2. An apparatus according to claim 1, wherein said developing device further includes detecting means for detecting the level of the surface of the developer.

3. An apparatus according to claim 2, wherein said detecting means is capable of detecting the level of the surface of the developer at a first level and a second level which is higher than the first level, and when the first level is detected, said developer supply device starts to supply a predetermined amount of the developer to said developing device, and when the second level is detected, the supply of the developer to said developing device is stopped.

4. An apparatus according to claim 3, wherein said developer supply device, during an image forming operation, supplies the developer to said developing device at a predetermined rate of supply per unit time.

5. An apparatus according to claim 2, wherein said detecting means is capable of detecting the level of the surface of the developer at a plurality of levels, wherein when said detecting means detects a maximum level among the plurality of levels, the supply of the developer from said developer supply device to said developing device is stopped, and wherein when said detecting means detects a level of the surface of the developer other than the maximum level, the supply of the developer from said developer supply device to said developing device is resumed.

6. An apparatus according to claim 2, wherein said detecting means is capable of detecting the level of the surface of the developer at a plurality of levels, and the image forming apparatus further comprises notification means for notifying a shortage of the developer in said developer supply device or an abnormality of said developer supply device when a minimum level among the plurality of levels is detected.

7. An apparatus according to claim 1, wherein said developing device further includes a developer chamber containing said carrying member, said developer supply device and said developer regulating means; a stirring chamber containing said developer stirring means; and an opening formed between said developer chamber and said stirring chamber, and wherein said stirring chamber is disposed vertically above said developer chamber with said opening therebetween.

8. An apparatus according to claim 7, wherein the opening is provided so as to cross with a plane perpendicular to the vertical direction.

9. An apparatus according to claim 1, wherein the level of the surface of the developer maintained by said control means is higher, in a vertical direction, than a center of the moveable range of said developer stirring means and which is not higher than an upper end of the moveable range of said developer stirring means.

10. An apparatus according to claim 1, wherein said carrying member is contactable to said image bearing member.

11. An apparatus according to claim 1, wherein a peripheral movement direction of said developer supply device is opposite to a peripheral movement direction of said carrying member at a position where said developer supply device and said carrying member is contacted to each other, and said developer supply device is effective to remove the developer from said carrying member.

12. An apparatus according to claim 1, wherein said developing device is detachably mountable to a main assembly of the image forming apparatus.

13. An apparatus according to claim 1, wherein said developing device is provided in a process cartridge which is detachably mountable relative to a main assembly of the image forming apparatus together with said image bearing member.

14. An apparatus according to claim 1, wherein said developer supply device is detachably mountable relative to a main assembly of the image forming apparatus.

15. An apparatus according to claim 1, wherein the one component developer has a shape factor SF-1 of 100-140 and a shape factor SF-2 of 100-120.

16. An apparatus according to claim 15, wherein a part or all of the one component developer is produced through a polymerization method.

17. An apparatus according to claim 1, wherein the one component developer is non-magnetic.

18. An apparatus according to claim 1, wherein said control means controls said developer supply device such that the upper limit of the height of the surface of the developer is vertically below a top end of the moveable range of said developer stirring means.

19. An apparatus according to claim 18, wherein said control means controls said developer supply device such that the lower limit of the height of the surface of the developer is vertically above a center of rotation of said developer stirring means.

20. An apparatus according to claim 1, wherein a direction of rotation of said developer supplying means is such that developer supplying means is contacted to said carrying member during a downward part of the rotation of said developer supplying means.

* * * * *